United States Patent [19]

Sakurai

[11] 4,124,977

[45] Nov. 14, 1978

[54] EXHAUST PORT LINER SUPPORT SYSTEM

[75] Inventor: Yoshitoshi Sakurai, Saitama, Japan

[73] Assignee: Honda Giken Kogyo Kabushiki Kaisha, Tokyo, Japan

[21] Appl. No.: 718,094

[22] Filed: Aug. 26, 1976

[30] Foreign Application Priority Data

Aug. 27, 1975 [JP] Japan ..... 75-103069

[51] Int. Cl.[2] ..... F01N 7/08

[52] U.S. Cl. ..... 60/282; 60/322; 123/193 H

[58] Field of Search ..... 60/272, 282, 322, 323; 123/191 A, 193 H

[56] References Cited

U.S. PATENT DOCUMENTS

| | | | |
|---|---|---|---|
| 2,257,631 | 9/1941 | Wahlberg | 60/323 |
| 3,969,893 | 7/1976 | Sakurai | 60/323 |
| 3,983,696 | 10/1976 | Pflugfelder | 60/282 |
| 4,016,846 | 4/1977 | Nakano | 123/122 AB |
| 4,031,699 | 6/1977 | Suga | 123/191 A |

FOREIGN PATENT DOCUMENTS

| | | | |
|---|---|---|---|
| 2,323,793 | 11/1974 | Fed. Rep. of Germany | 60/282 |

*Primary Examiner*—Douglas Hart
*Attorney, Agent, or Firm*—Lyon & Lyon

[57] ABSTRACT

An exhaust port liner system for an engine having an exhaust port with a common outlet and a dual inlet for the exhaust of two adjacent cylinders wherein an exhaust port liner is positioned within the exhaust port with a clearance about its periphery between the exhaust port and the exhaust port liner. A portion of the exhaust port liner has two legs with a space between them. The exhaust port liner is secured to the exhaust port at the common exhaust port outlet, and each leg is fitted and supported at the outer sides of the two exhaust port inlet sidewalls.

4 Claims, 5 Drawing Figures

EXHAUST PORT LINER SUPPORT SYSTEM

Exhaust ports having liners fitted to, and supported by, the mouth peripheral section of the exhaust port at its downstream or outlet end are known. However, such systems are somewhat unstable due to the cantilever support of the liner. Such systems are likely to allow the upstream end of the exhaust port liner to vibrate in the exhaust port. Further, the large loads of the support system at the downstream end may cause damage to the system.

It is an object of this invention to produce an improved exhaust port liner support system for an engine. Other and additional objections will be apparent upon a review of the entire specification including the drawings and claims.

This invention provides an improved exhaust port liner system for an engine having an exhaust port with a common outlet and a dual inlet for the exhaust of two adjacent cylinders. An exhaust port liner is positioned within the exhaust port with a clearance about its periphery between the exhaust port and the exhaust port liner. The exhaust port liner is secured to the exhaust port at the exhaust port outlet, and is fitted and supported at the outer sides of dual exhaust port inlet sidewalls. Such an arrangement provides a stable support for the exhaust port liner and eliminates vibration during operation. Further, the configuration more evenly distributes the support load while allowing the liner to thermally expand and contract lengthwise.

Figure 1:
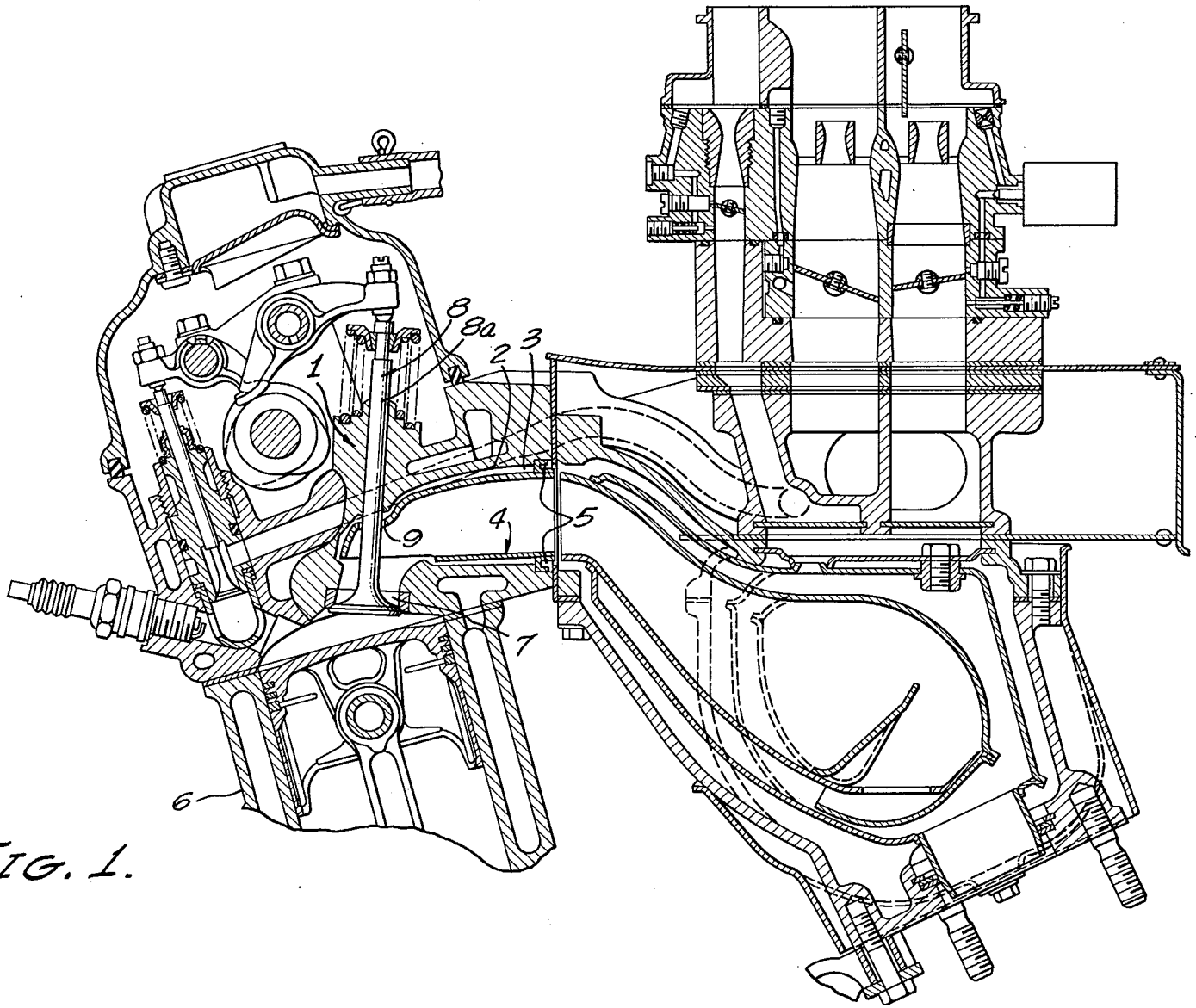
FIGS. 1 and 2 are partial cross-sectional views of an engine employing the invention.
Figure 2:
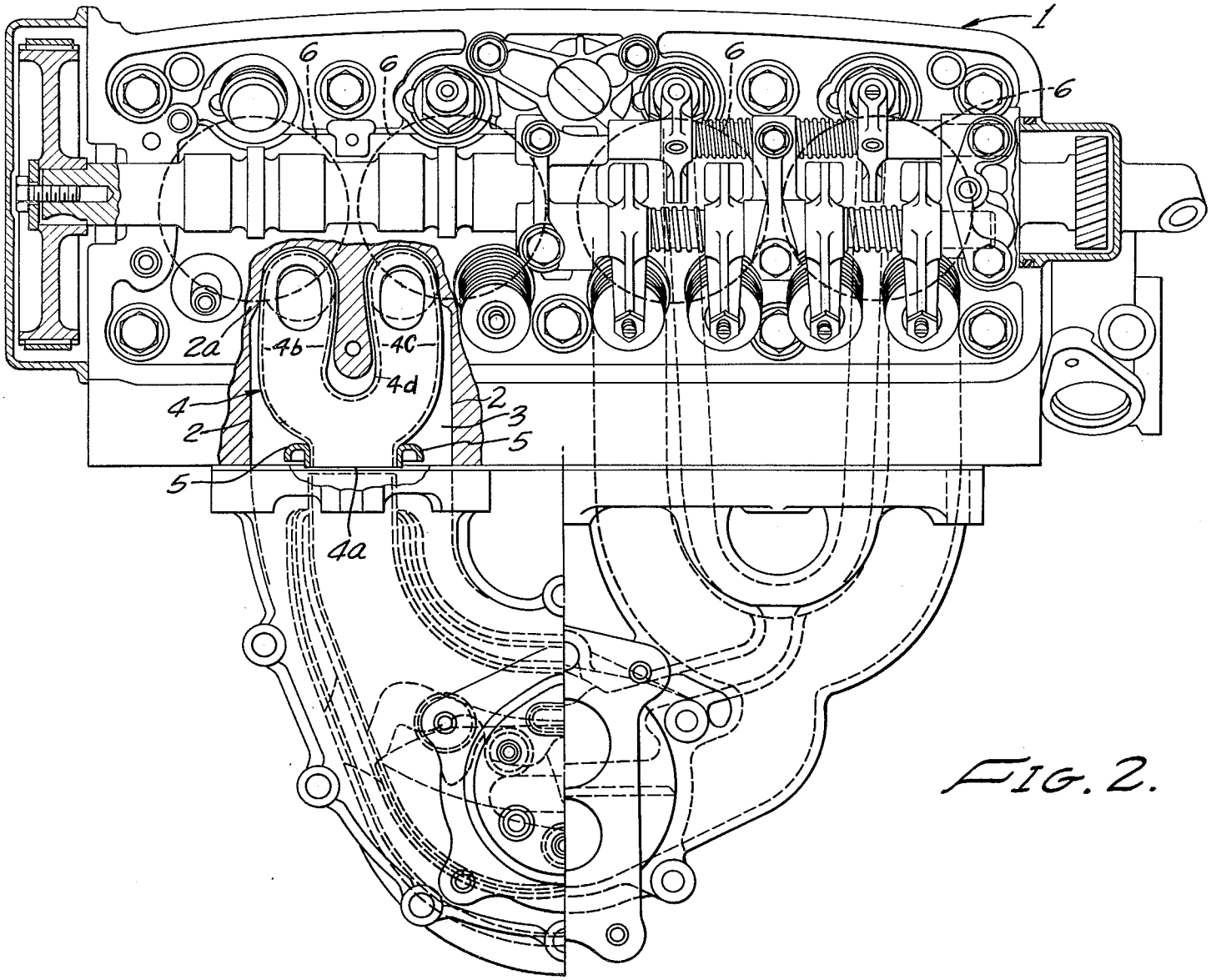

Referring now to the drawings, a four cylinder engine, generally referred to as 1, is shown having pairs of exhaust ports 2 located therein, and leading from pairs of adjacent cylinders 6. An exhaust port liner 4 is inserted into and positioned within each pair exhaust ports 2 so as to provide a clearance 3 around its periphery and front end as shown in FIG. 1. The outlet **4*a* of the exhaust port liner 4 may be secured to the mouth of the exhaust port 2 by means of a bushing 5**.

The exhaust port liner 4 is bifurcated at its upstream or inlet portion to form two legs **4*b* and 4*c* separated by a space 4*d*. Exhaust valve seats 7 communicate with the upstream or inlet end of the exhaust port 2. The front ends of the exhaust port liner 4 are each provided with a through hole 9 to which the stem 8*a* of an exhaust valve 8** may be inserted.

Figure 3:
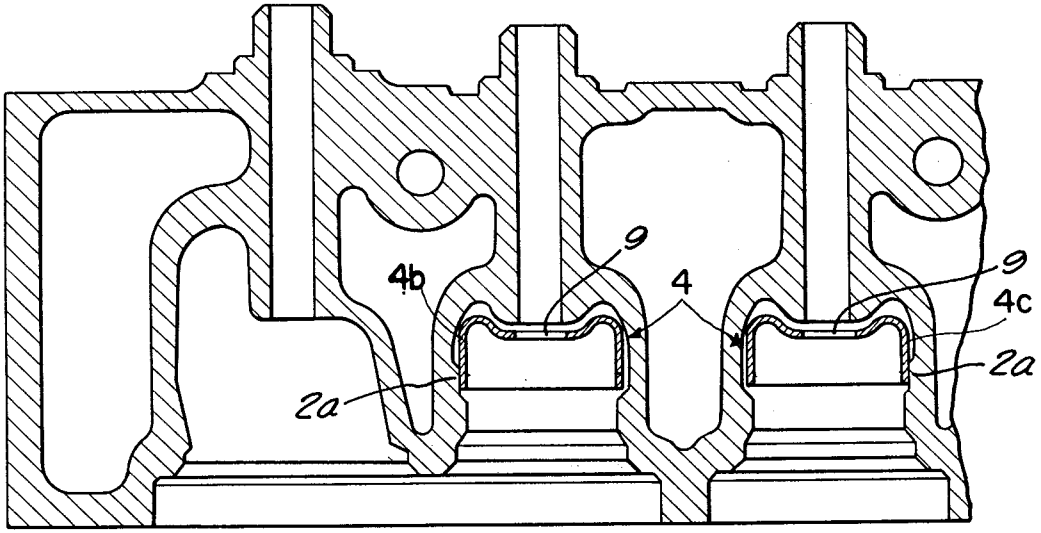
FIGS. 3 and 4 are cross-sectional views of alternate embodiments of the exhaust port liner system invention.
Figure 5:
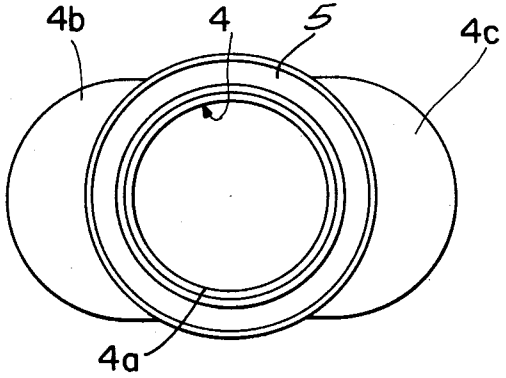
FIG. 5 is an end view of the engine exhaust port liner of this invention.

FIG. 3 illustrates an embodiment wherein the outer portion of the sidewall of exhaust port 2 projects inwardly at **2*a* so as to insure that the legs 4*b* and 4*c* of the exhaust port liner 4 are snugly fitted to and supported from the outer sidewalls 2*a* of the exhaust port 2**.

Figure 4:
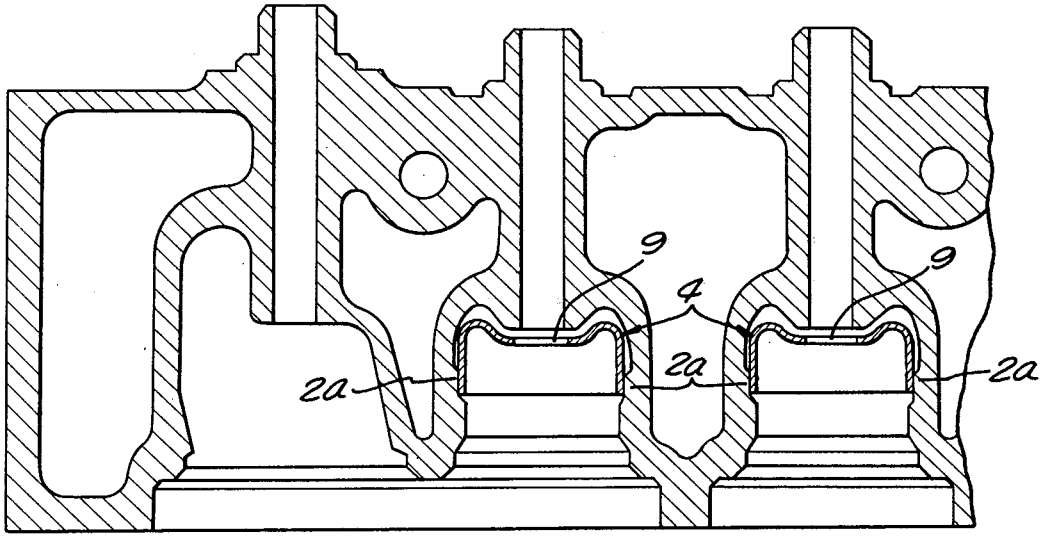

FIG. 4 illustrates an embodiment in which both sides of each leg **4*b* and 4*c* contact a portion of the side wall of exhaust port 2 so that both opposed sides of the legs of the exhaust port liner 4 are snugly fitted to and supported from the opposed side walls 2*a*** of the exhaust port.

It is to be understood that the embodiments described above may be slightly modified by those skilled in the art without departing from the spirit of the present invention. Accordingly, the scope of this invention is to be limited only by the appended claims.

What is claimed is:

1. An engine exhaust port liner system comprising an exhaust port, said exhaust port having first and second exhaust port inlets and a common exhaust port outlet; and an exhaust port liner removably inserted and positioned within said exhaust port so as to provide a clearance around the periphery of said exhaust port liner between said exhaust port and said exhaust port liner except at said first and second exhaust port inlets and said exhaust port outlet, said exhaust port liner having a common exhaust port liner outlet and having a pair of spaced legs each provided with an inlet, said exhaust port liner outlet being slideably secured to said exhaust port outlet, said first and second exhaust port inlets being further defined as each having an exhaust port inlet sidewall, and said exhaust port liner legs being further defined as each having an exhaust port liner inlet side wall which is fitted against said exhaust port inlet sidewalls respectively, so that exhaust port inlet is allowed to thermally expand and contract lengthwise at both said exhaust port inlets and said exhaust port outlet.

2. An engine exhaust port liner system comprising an exhaust port, said exhaust port having first and second exhaust port inlets and a common exhaust port outlet; and an exhaust port liner removably inserted and positioned within said exhaust port so as to provide a clearance around the periphery of said exhaust port liner between said exhaust port and said exhaust port liner except at said exhaust port outlet and a portion of said exhaust port inlets, said exhaust port liner having a common exhaust port liner outlet and having a pair of spaced legs each provided with an inlet, said exhaust port liner outlet being slideably secured to said exhaust port outlet, said first and second exhaust port inlets being further defined as each having an exhaust port inlet sidewall, and said exhaust port liner legs being further defined as each having an exhaust port liner inlet sidewall wherein an outer side of said exhaust port inlet sidewalls projects inwardly so as to engage a side of each said exhaust port liner legs, respectively, so that said exhaust port liner is allowed to thermally expand and contract lengthwise at both said exhaust port inlets and said exhaust port outlet, and further so that said exhaust port liner is allowed to thermally expand and contract transversely at said exhaust port inlets.

3. An engine exhaust port liner system as claimed in claim 1 wherein sides of said exhaust port inlet side walls project inwardly so as to engage both sides of each of said exhaust port liner legs, respectively.

4. An engine exhaust port liner system as claimed in claim 1 wherein said exhaust port liner legs are further defined as each having a through hole to allow for the movement of an exhaust valve stem therethrough.

* * * * *